US010667616B1

(12) United States Patent
Lai et al.

(10) Patent No.: US 10,667,616 B1
(45) Date of Patent: Jun. 2, 2020

(54) LIFTING STRUCTURE FOR ARMREST

(71) Applicants: Yen-Chuan Lai, Taibao (TW); Yen-Chi Lai, Chiayi (TW)

(72) Inventors: Yen-Chuan Lai, Taibao (TW); Yen-Chi Lai, Chiayi (TW)

( * ) Notice: Subject to any disclaimer, the term of this patent is extended or adjusted under 35 U.S.C. 154(b) by 0 days.

(21) Appl. No.: 16/244,430

(22) Filed: Jan. 10, 2019

(51) Int. Cl.
*A47C 7/54* (2006.01)

(52) U.S. Cl.
CPC ..... *A47C 7/541* (2018.08)

(58) Field of Classification Search
CPC ..... A47C 7/541; A47C 7/54; A47C 1/0305; A47C 1/0303
USPC ..... 297/411.36, 411.35
See application file for complete search history.

(56) References Cited

U.S. PATENT DOCUMENTS 5,382,079 A * 1/1995 Wilson ..... A47C 1/03 297/411.35
5,931,537 A * 8/1999 Gollin ..... A47C 1/03 297/411.27
6,139,107 A * 10/2000 Lee ..... A47C 1/03 297/411.35
6,540,300 B2 * 4/2003 Piretti ..... A47C 1/03 297/411.35
6,896,333 B1 * 5/2005 Matern ..... A47C 1/03 297/411.36
7,896,440 B2 * 3/2011 Tsai ..... A47C 1/03 297/353

* cited by examiner

*Primary Examiner* — Milton Nelson, Jr.
(74) *Attorney, Agent, or Firm* — Alan D. Kamrath; Mayer & Williams PC

(57) ABSTRACT

A lifting structure for an armrest mounted on a left side or a right side of a chair contains: an accommodation sleeve, a fixer, a swing arm retained in one of multiple recesses of the fixer via a slidable seat, an extension located between two drive members of the swing arm and accommodated inside a receiving tab of the slidable seat, and a connection plate covered on the accommodation sleeve so that the fixer is connected with a holder, and the connection plate is coupled with an armrest seat, thus connecting the armrest. The accommodation sleeve includes two concave seats. The fixer includes a groove and two closed slots. The slidable seat includes the receiving tab, two ribs extending, two cutouts, and two elongated orifices. The swing arm includes a coupling rod, an oblique hole, a locking projection, a column, and an indentation.

2 Claims, 6 Drawing Sheets

LIFTING STRUCTURE FOR ARMREST

BACKGROUND OF THE INVENTION

Field of the Invention

The present invention relates to a lifting structure which is applicable for each of two armrests on a left side and a right side of a chair so that user presses two drive members to lift and descend each armrest, thus reducing spare parts and simplifying manufacture of the two armrests.

Description of the Prior Art

A conventional lifting structure for an armrest is applied to lift and descend an armrest seat of a chair based on using requirements so as to support user's two arms.

The conventional lifting structure contains an adjustment knob mounted outside an accommodation sleeve, a locking projection pushed by a spring to lift and to descend repeatedly. The armrest seat is pressed downward to a bottommost position after being gradually adjusted to a topmost position (because when the locking projection is located on a topmost position of the armrest seat, it moves into a dead point, and the locking projection removes from the dead point after pressing the armrest seat to the bottommost position, thus lifting and descending the armrest seat troublesomely), and the armrest seat is lifted again.

Accordingly, two armrests mounted on a lift side and a right side of the chair have different spare parts, thus increasing manufacture cost. In addition, the armrest seat is lifted after being descended to cause inconvenient operation.

The present invention has arisen to mitigate and/or obviate the afore-described disadvantages.

SUMMARY OF THE INVENTION

The primary objective of the present invention is to provide a lifting structure for an armrest which contains two drive members exposing outside the accommodation sleeve to drive the locking projection to remove from or retain into one of the multiple recesses so that the armrest seat and the accommodation sleeve are lifted and descend relative to the fixer based on using requirements.

Another objective of the present invention is to provide a lifting structure for an armrest which contains an extension between two drive members on a top of the swing arm extending through and accommodated inside a receiving tab on a top of the slidable seat, and a connection plate covered on the accommodation sleeve, wherein the two drive members exposing outside the two ends of the top of the accommodation sleeve respectively so as to be operated symmetrically, and the lifting structure is applicable for each of two armrests on the left side and the right side of the chair so that user presses the two drive members to lift and descend each armrest, thus reducing spare parts and simplifying manufacture of the two armrests.

A lifting structure provided by the present invention is applicable for an armrest mounted on a left side or a right side of a chair, and the lifting structure contains: an accommodation sleeve accommodating a fixer, a swing arm retained in one of multiple recesses of the fixer via a slidable seat, an extension between two drive members on a top of the swing arm extending through and accommodated inside a receiving tab on a top of the slidable seat, and a connection plate covered on the accommodation sleeve so that a bottom of the fixer is connected with a holder, and a top of the connection plate is coupled with an armrest seat, thus connecting the armrest.

DETAILED DESCRIPTION OF THE PREFERRED EMBODIMENTS

The present invention will be clearer from the following description when viewed together with the accompanying drawings, which show, for purpose of illustrations only, a preferred embodiment in accordance with the present invention.

Figure 1:
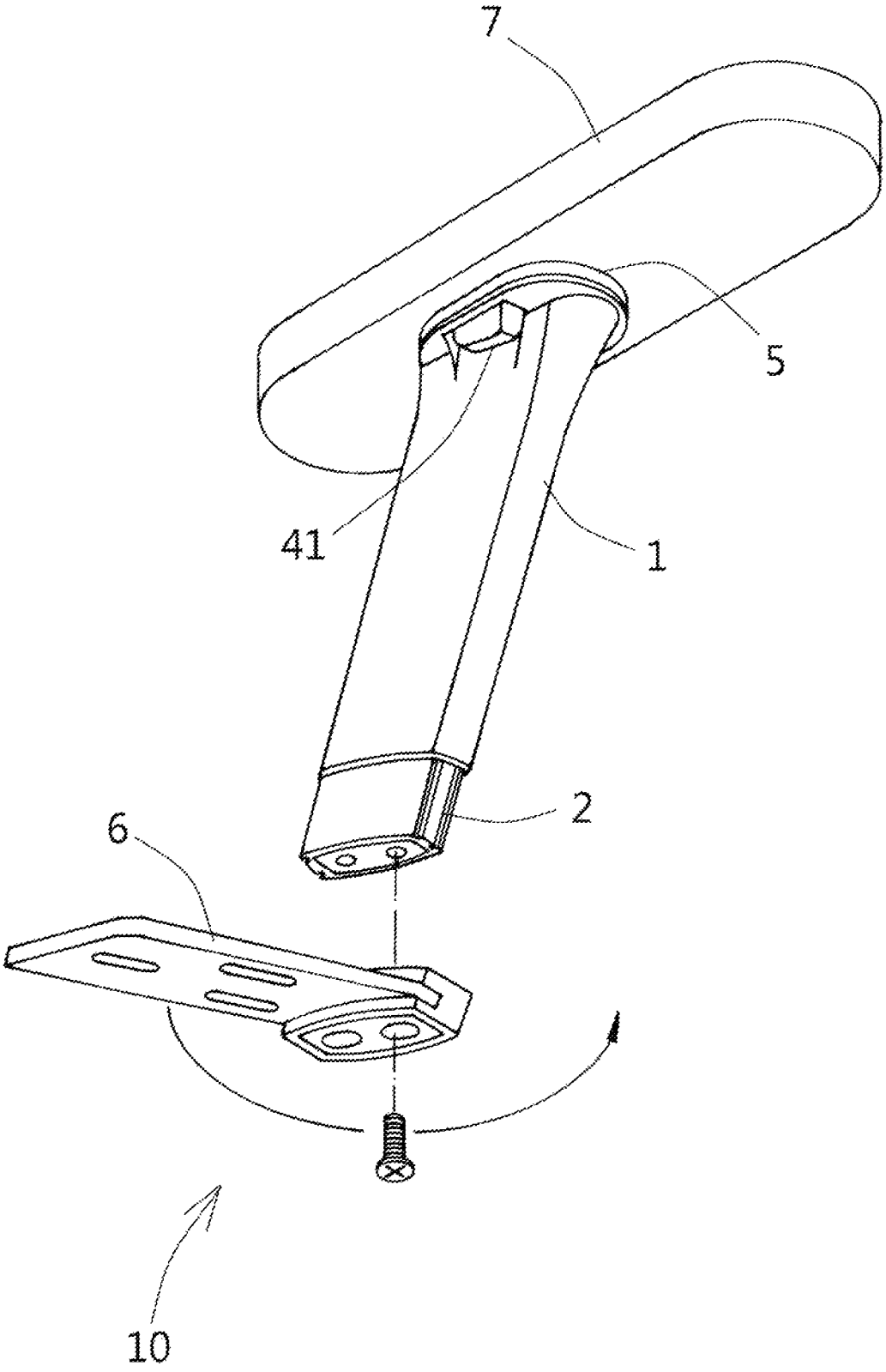
FIG. 1 is a perspective view showing the exploded components of an armrest according to a preferred embodiment of the present invention.
Figure 2:
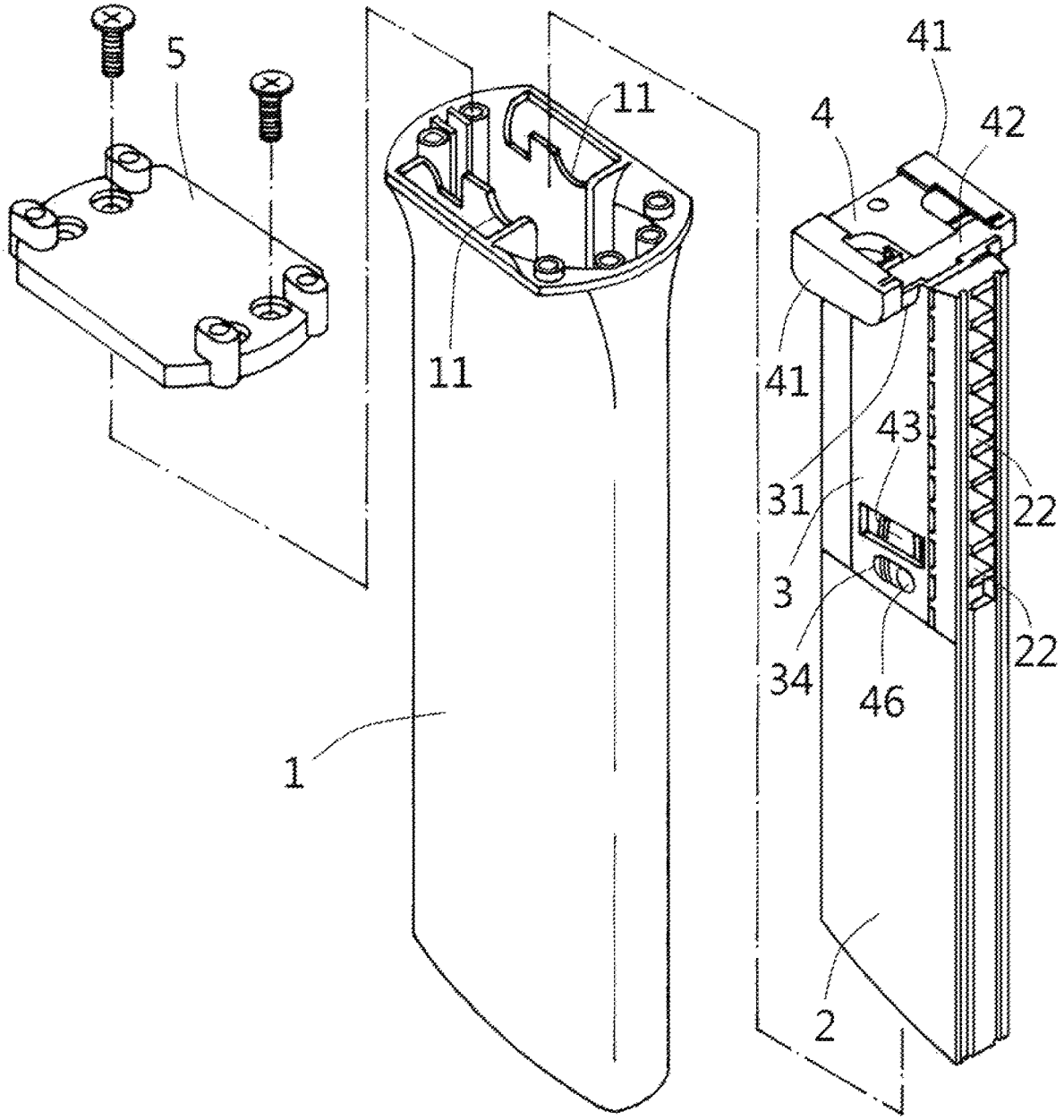
FIG. 2 is a perspective view showing the exploded components of a lifting structure for the armrest according to the preferred embodiment of the present invention.
Figure 3:
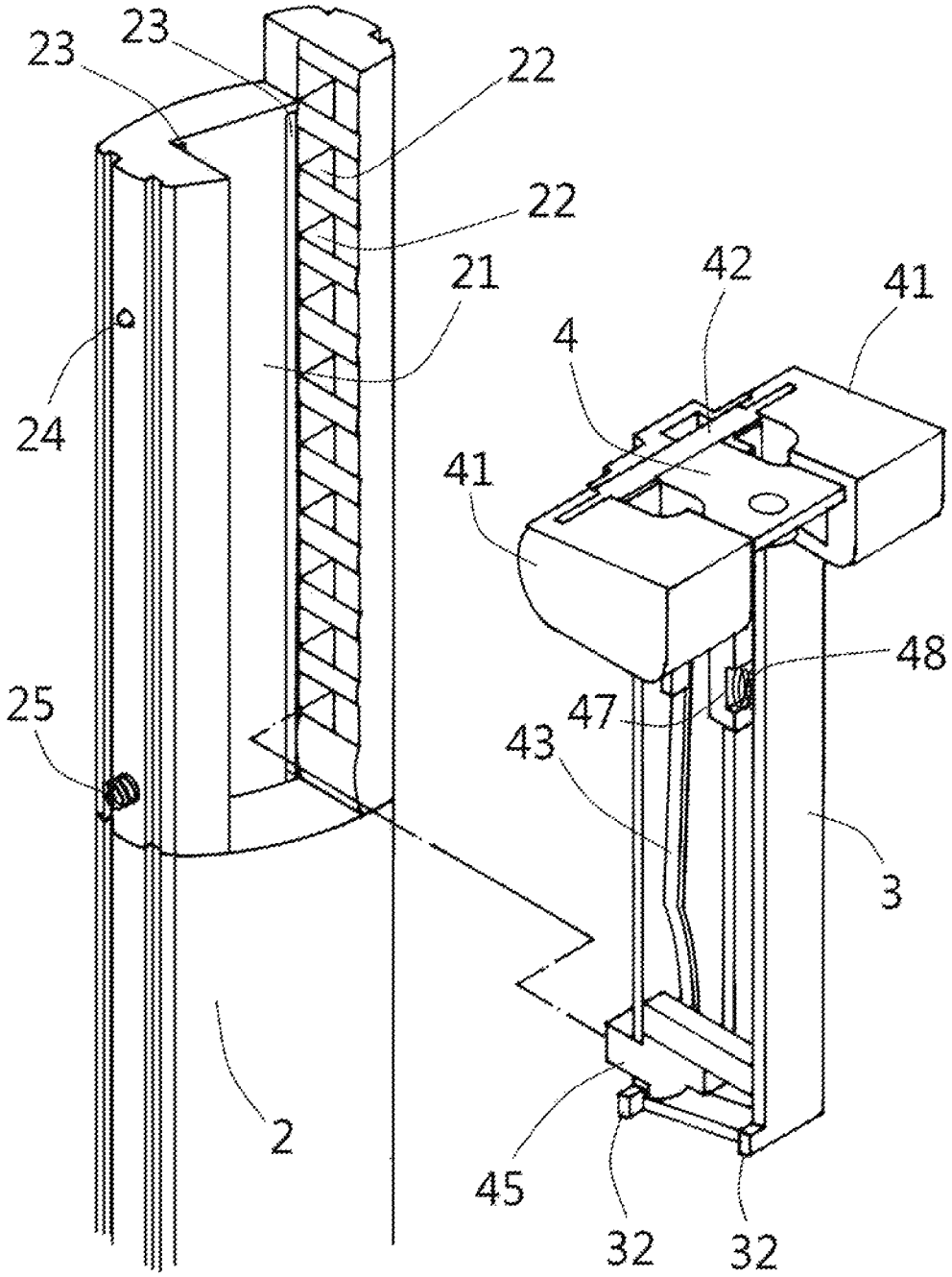
FIG. 3 is another perspective view showing the exploded components of the lifting structure for the armrest according to the preferred embodiment of the present invention.
Figure 4:
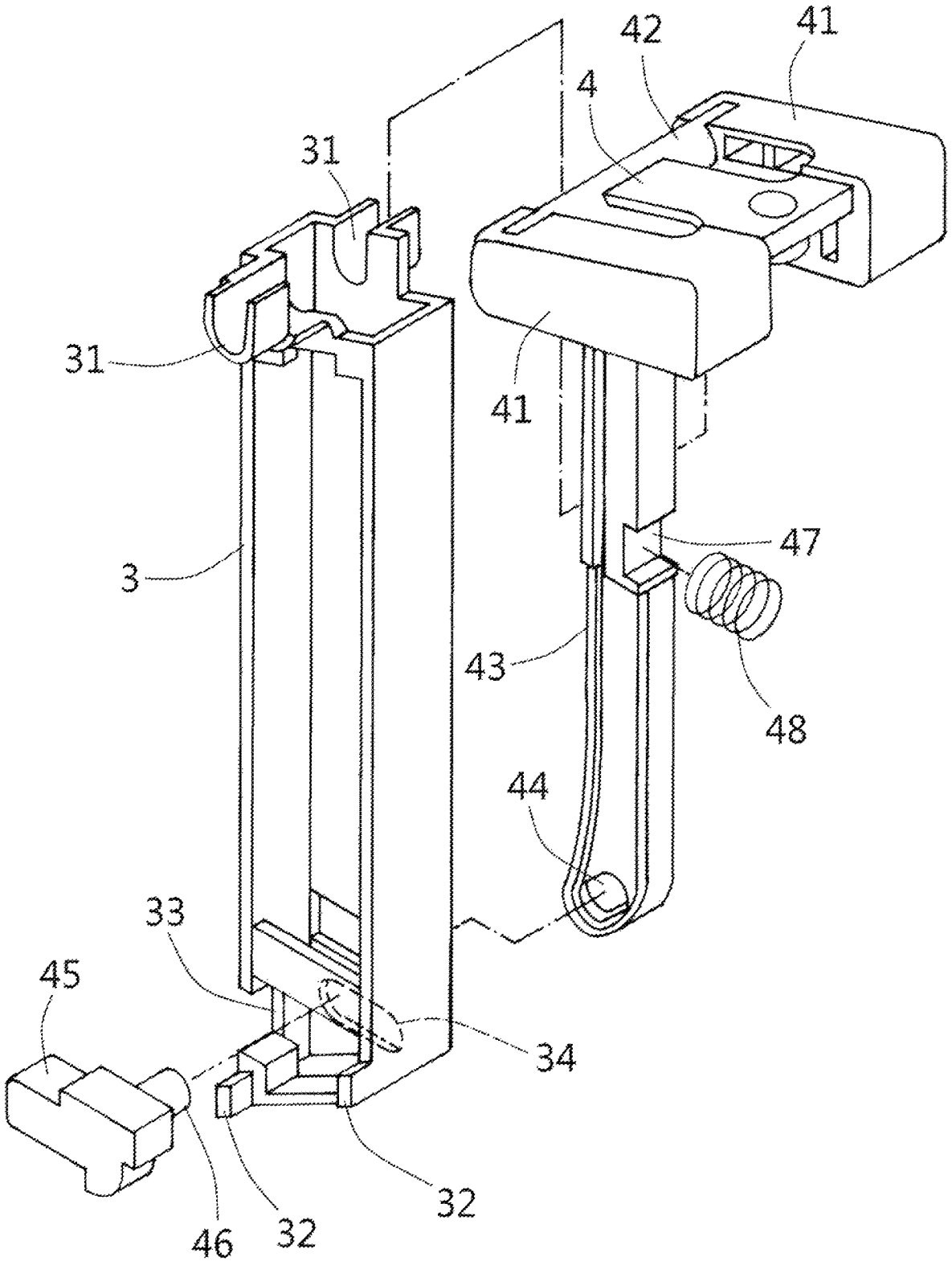
FIG. 4 is also another perspective view showing the exploded components of the lifting structure for the armrest according to the preferred embodiment of the present invention.

A lifting structure for an armrest 10 mounted on a left side or a right side of a chair according to a preferred embodiment of the present invention comprises: an accommodation sleeve 1 accommodating a fixer 2 (as shown in FIG. 1), a swing arm 4 retained in one of multiple recesses 22 of the fixer 2 via a slidable seat 3 (as illustrated in FIG. 2), an extension 42 between two drive members 41 on a top of the swing arm 4 extending through and accommodated inside a receiving tab 31 on a top of the slidable seat 3 (as shown in FIGS. 3 and 4), and a connection plate 5 covered on the accommodation sleeve 1 so that a bottom of the fixer 2 is connected with a holder 6, and a top of the connection plate 5 is coupled with an armrest seat 7, thus connecting the armrest 10.

The accommodation sleeve 1 is hollow to accommodate the fixer 2 and includes two concave seats 11 formed on two ends of a top of the accommodation sleeve 1 respectively.

The fixer 2 includes a groove 21 defined thereon, two closed slots 23 formed on two sides of the groove 21 individually, and the multiple recesses 22 defined on a side of the groove 21, wherein the multiple recesses 22 communicate with one another.

The slidable seat 3 includes the receiving tab 31 being open and extending outward from the top of the slidable seat 3, two ribs 32 extending outward from two sides of the slidable seat 3 and corresponding to the two closed slots 23 individually so as to slide in the groove 21, two cutouts 33 formed on a bottom of the slidable seat 3, and two elongated orifices 34 defined on the slidable seat 3 and located adjacent to the two cutouts 33 individually.

The swing arm 4 includes the two drive members 41 formed on two ends of the extension 42 respectively, a coupling rod 43 extending from a bottom of the extension 42, an oblique hole 44 defined in a lower end of the coupling rod 43, a locking projection 45 accommodated in the one recess 22 via the oblique hole 44, a column 46 extending from the locking projection 45 and retained in the one recess 22, and an indentation 47 defined on the coupling rod 43 opposite to the locking projection 45 and received into a first spring 48.

The connection plate 5 is covered on the top of the accommodation sleeve 1.

Figure 5:
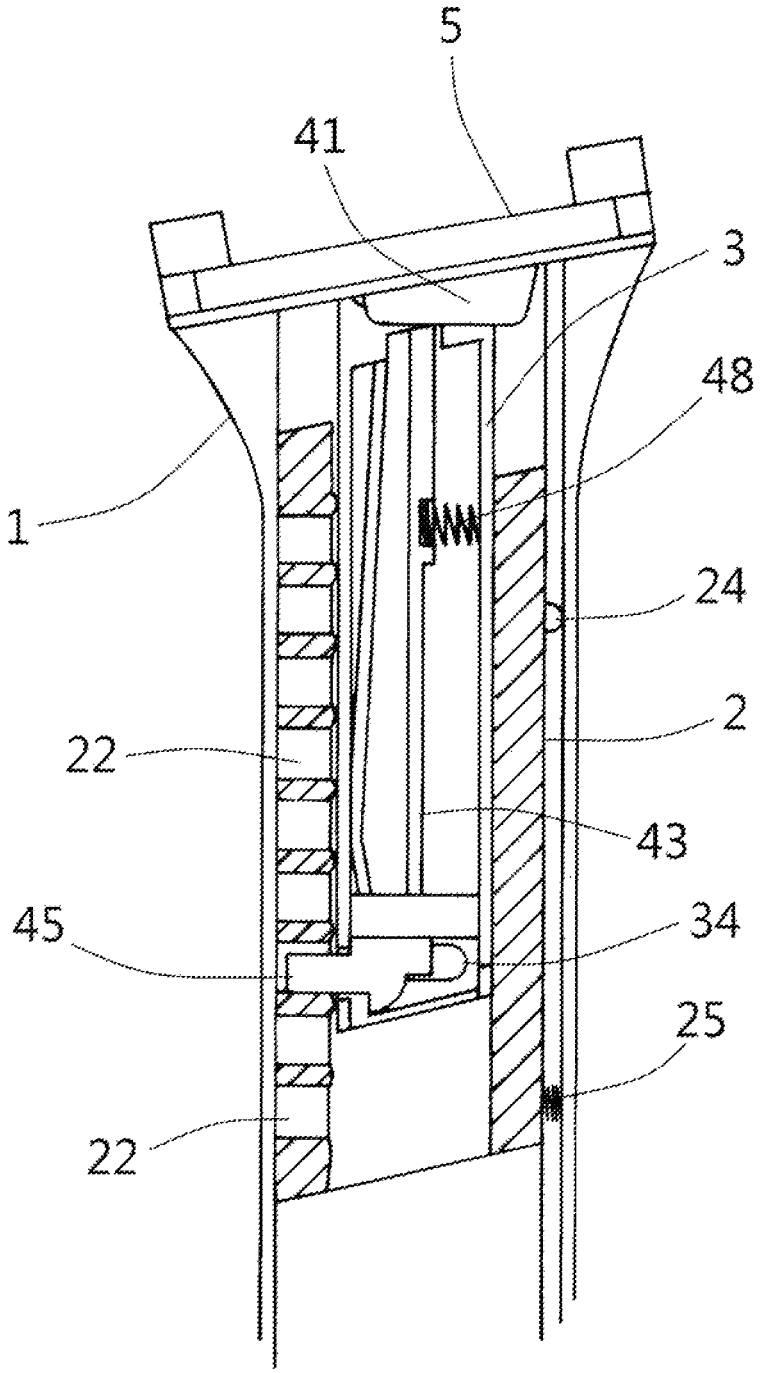
FIG. 5 is a cross sectional view showing the assembly of the lifting structure for the armrest according to the preferred embodiment of the present invention.

In assembly, the coupling rod 43 of the swing arm 4 is inserted into the top of the slidable seat 3 so that the extension 42 of the two drive members 41 extends through and is accommodated inside the receiving tab 31, the first spring 48 abuts against the indentation 47 and an inner wall of the slidable seat 3, hence when the column 46 of the locking projection 45 is inserted into the two elongated orifices 34 via the oblique hole 44, the locking projection 45 extends out of the two cutouts 33. In the meantime, the locking projection 45 is pushed inward and the slidable seat 3 is put into the groove 21 of the fixer 2 so that the two ribs 32 of the slidable seat 3 are inserted into the two closed slots 23 respectively (since the two closed slots 23 are concavely closed and do not extend openly). When the slidable seat 3 slides in the groove 21, the two ribs 32 stop a removal of the slidable seat 3 from the groove 21, and the locking projection 45 is pushed by the first spring 48 to engage in the one recess 22 (as illustrated in FIG. 5). The fixer 2 is fitted into the accommodation sleeve 1 so that the receiving tab 31 of the slidable seat 3 is mounted in the two concave seats 11 of the accommodation sleeve 1, and the two drive members 41 of the swing arm 4 expose outside the two ends of the top of the accommodation sleeve 1. Thereafter, the connection plate 5 is covered on the top of the accommodation sleeve 1 so that the bottom of the fixer 2 is connected with the holder 6, and the top of the connection plate 5 is coupled with the armrest seat 7, thus connecting the armrest 10.

Figure 6:
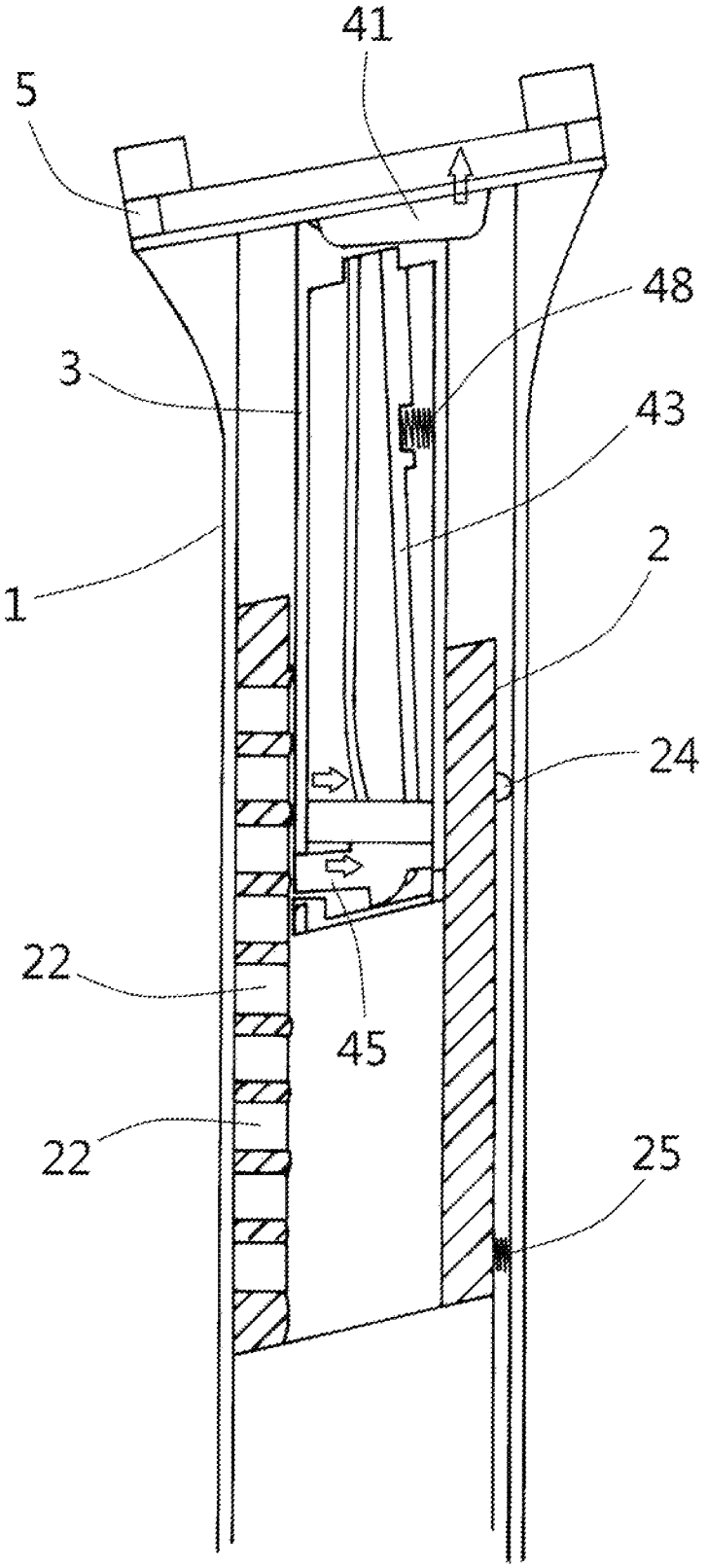
FIG. 6 is a cross sectional view showing the operation of the lifting structure for the armrest according to the preferred embodiment of the present invention.

In operation, the two drive members 41 are pressed to drive the coupling rod 43 of the swing arm 4 to swing, and the first spring 48 is pressed by the coupling rod 43 (as shown in FIG. 6), such that the locking projection 45 is pushed inward to remove from the one recess 22, and the armrest seat 7 is lifted or descended freely relative to the fixer 2 (wherein the armrest seat 7, the connection plate 5, the accommodation sleeve 1, the swing arm 4, and the slidable seat 3 are lifted or descended relative to the fixer 2), then the two drive members 41 are released so that the first spring 48 recovers to an original position and the locking projection 45 is engaged into another recess 22, thus operating the armrest 10 easily.

Accordingly, the two drive members 41 expose outside the two ends of the top of the accommodation sleeve 1 respectively so as to be operated symmetrically. Preferably, the lifting structure is applicable for each of two armrests 10 on the left side and the right side of the chair so that user presses the two drive members 41 to lift and descend each armrest 10, thus reducing spare parts and simplifying manufacture of the two armrests 10.

Furthermore, the fixer 2 further includes a boss 24 formed on an upper end thereof, and the fixer 2 includes a second spring 25 extending out of a lower end of the fixer 2, such that when the fixer 2 is fitted into the accommodation sleeve 1, the boss 24 and the second spring 25 abut against an inner wall of the accommodation sleeve 1, thus fitting the fixer 2 into the accommodation sleeve 1 securely.

While various embodiments in accordance with the present invention have been shown and described, it is clear to those skilled in the art that further embodiments may be made without departing from the scope of the present invention.

What is claimed is:

1. A lifting structure for an armrest mounted on a left side or a right side of a chair comprising:

an accommodation sleeve accommodating a fixer, a swing arm retained in one of multiple recesses of the fixer via a slidable seat, an extension between two drive members on a top of the swing arm extending through and accommodated inside a receiving tab on a top of the slidable seat, and a connection plate covered on the accommodation sleeve so that a bottom of the fixer is connected with a holder, and a top of the connection plate is coupled with an armrest seat, thus connecting the armrest;

wherein the accommodation sleeve is hollow to accommodate the fixer and includes two concave seats formed on two ends of a top of the accommodation sleeve respectively;

wherein the fixer includes a groove defined thereon, two closed slots formed on two sides of the groove individually, and the multiple recesses defined on a side of the groove, wherein the multiple recesses communicate with one another;

wherein the slidable seat includes the receiving tab being open and extending outward from the top of the slidable seat, two ribs extending outward from two sides of the slidable seat and corresponding to the two closed slots individually so as to slide in the groove, two cutouts formed on a bottom of the slidable seat, and two elongated orifices defined on the slidable seat and located adjacent to the two cutouts individually;

wherein the swing arm includes the two drive members formed on two ends of the extension respectively, a coupling rod extending from a bottom of the extension, an oblique hole defined in a lower end of the coupling rod, a locking projection accommodated in the one recess via the oblique hole, a column extending from the locking projection and retained in the one recess, and an indentation defined on the coupling rod opposite to the locking projection and received into a first spring; and wherein the connection plate is covered on the top of the accommodation sleeve;

wherein the coupling rod of the swing arm is inserted into the top of the slidable seat so that the extension of the two drive members extends through and is accommodated inside the receiving tab, the first spring abuts against the indentation and an inner wall of the slidable seat, hence when the column of the locking projection is inserted into the two elongated orifices via the oblique hole, the locking projection extends out of the two cutouts, and the locking projection is pushed inward and the slidable seat is put into the groove of the fixer so that the two ribs of the slidable seat are inserted into the two closed slots respectively, and the slidable seat slides in the groove, thereafter the fixer is fitted into the accommodation sleeve so that the receiving tab of the slidable seat is mounted in the two concave seats of the accommodation sleeve, and the two drive members of the swing arm expose outside the two ends of the top of the accommodation sleeve, and the two drive members are pressed to drive the coupling rod of the swing arm to swing, and the first spring is pressed by the coupling rod, such that the locking projection is pushed inward to remove from the one recess, and the armrest seat is lifted or descended freely relative to the fixer, then the two drive members are released so that the first spring recovers to an original position and the locking projection is engaged into another recess.

2. The lifting structure as claimed in claim 1, wherein the fixer further includes a boss formed on an upper end thereof, and the fixer includes a second spring extending out of a lower end of the fixer, such that when the fixer is fitted into the accommodation sleeve, the boss and the second spring abut against an inner wall of the accommodation sleeve, thus fitting the fixer into the accommodation sleeve securely.

* * * * *